US008613484B2

(12) United States Patent
Mo

(10) Patent No.: US 8,613,484 B2
(45) Date of Patent: Dec. 24, 2013

(54) DETACHABLE CHAIR

(75) Inventor: Guo-Peng Mo, Huizhou (CN)

(73) Assignee: Genius Champion Enterprises Co., Ltd., Guangdong (CN)

( * ) Notice: Subject to any disclaimer, the term of this patent is extended or adjusted under 35 U.S.C. 154(b) by 0 days.

(21) Appl. No.: 13/474,722

(22) Filed: May 18, 2012

(65) Prior Publication Data

US 2013/0307309 A1 Nov. 21, 2013

(51) Int. Cl.
*A47C 7/54* (2006.01)
*A47C 7/00* (2006.01)

(52) U.S. Cl.
USPC ..... 297/440.2; 297/440.17; 297/411.26

(58) Field of Classification Search
USPC ..... 297/440.1, 394, 411.26, 411.27, 297/411.28, 411.29, 440.2, 410, 440.17
See application file for complete search history.

(56) References Cited

U.S. PATENT DOCUMENTS

| | | | | |
|---|---|---|---|---|
| 1,252,192 | A * | 1/1918 | Stanford | 297/411.23 |
| 2,030,635 | A * | 2/1936 | Horwitt et al. | 297/290 |
| 2,190,395 | A * | 2/1940 | Brady | 297/394 |
| 5,009,467 | A * | 4/1991 | McCoy | 297/411.36 |
| 6,164,725 | A * | 12/2000 | Santa Cruz et al. | 297/411.29 |
| 6,739,671 | B2 * | 5/2004 | De Maina | 297/440.1 |

* cited by examiner

*Primary Examiner* — Milton Nelson, Jr.

(57) ABSTRACT

A chair includes a base, a seat board, a frame unit, a backrest and two armrests. The base has a cylinder, legs, and casters. The seat board is connected to the top of the base and a support frame is connected to the base so as to be connected with the frame unit. The backrest and the two armrests are detachably connected to the frame unit. The backrest and the two armrests are made by durable Nylon so as to have proper curvatures that meet ergonomic requirements. The material of the backrest and the armrests can be detached and/or replaced.

3 Claims, 5 Drawing Sheets

DETACHABLE CHAIR

BACKGROUND OF THE INVENTION (1) Field of the Invention

The present invention relates to a detachable chair, and more particularly, to a chair that the backrest can be detached for cleaning purpose.

(2) Description of the Prior Art

Chairs are widely used in homes, offices or public areas. The chairs used in offices are required to provide comfortable sitting experience to the users because the users sit in the office chairs for a long time each day. A chair used in office may bring the users have different levels of pain and uncomfortable feelings if the chair is not designed properly and correctly.

Generally the conventional chairs used in offices are focused on the material used for the backrest and the structural strength of the whole chair, the conventional chairs do not have soft and comfortable design to meet ergonomic requirements. The material used for the backrest and the armrest cannot be detached from the chair so that when the users feel humidity and hot in the summer days, and cold in the winter days. The material used for the backrest and the armrest may be deformed permanently after being used for a period of time.

The present invention intends to provide a chair wherein the material of the backrest can be detached from the chair so as to be cleaned.

SUMMARY OF THE INVENTION

The present invention relates to a chair and comprises a base having a cylinder connected thereto which is connected with multiple legs, and each leg has a caster connected thereto. A support frame is connected to the base so as to be connected with a frame unit. A seat board is connected to the top of the base and a backrest and two armrests are detachably connected to the frame unit. The backrest and the two armrests are made by Nylon.

Preferably, the frame unit has two backrest frames and two armrest frames. Each of the armrest frames has a first end fixed to the mediate portion of the backrest frame, and a second end of each of the armrest frames has a threaded hole. Each of the armrests has a circular tube at the lower end thereof and the circular tube is connected to the armrest frame. Each of the circular tubes has holes and bolts extend through the holes and are connected to the threaded holes in the armrest frame to detachably connect the armrests to the armrest frames respectively. The backrest frame has connection tubes and the backrest has connectors on the rear side thereof. The connection tubes are detachably connected to the connectors.

Preferably, the frame unit has a headrest frame which is a curved frame and two connection sections extend from two ends thereof. The two backrest frames each have connection holes in which the connection sections of the headrest frame are connected. A headrest is connected to the mediate portion of the headrest frame.

Preferably, the headrest frame has a securing device at the mediate portion thereof and the headrest has a positioning member on the rear end thereof. The positioning member has multiple recesses and the securing device is securely engaged with the recesses.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENTS

Figure 1:
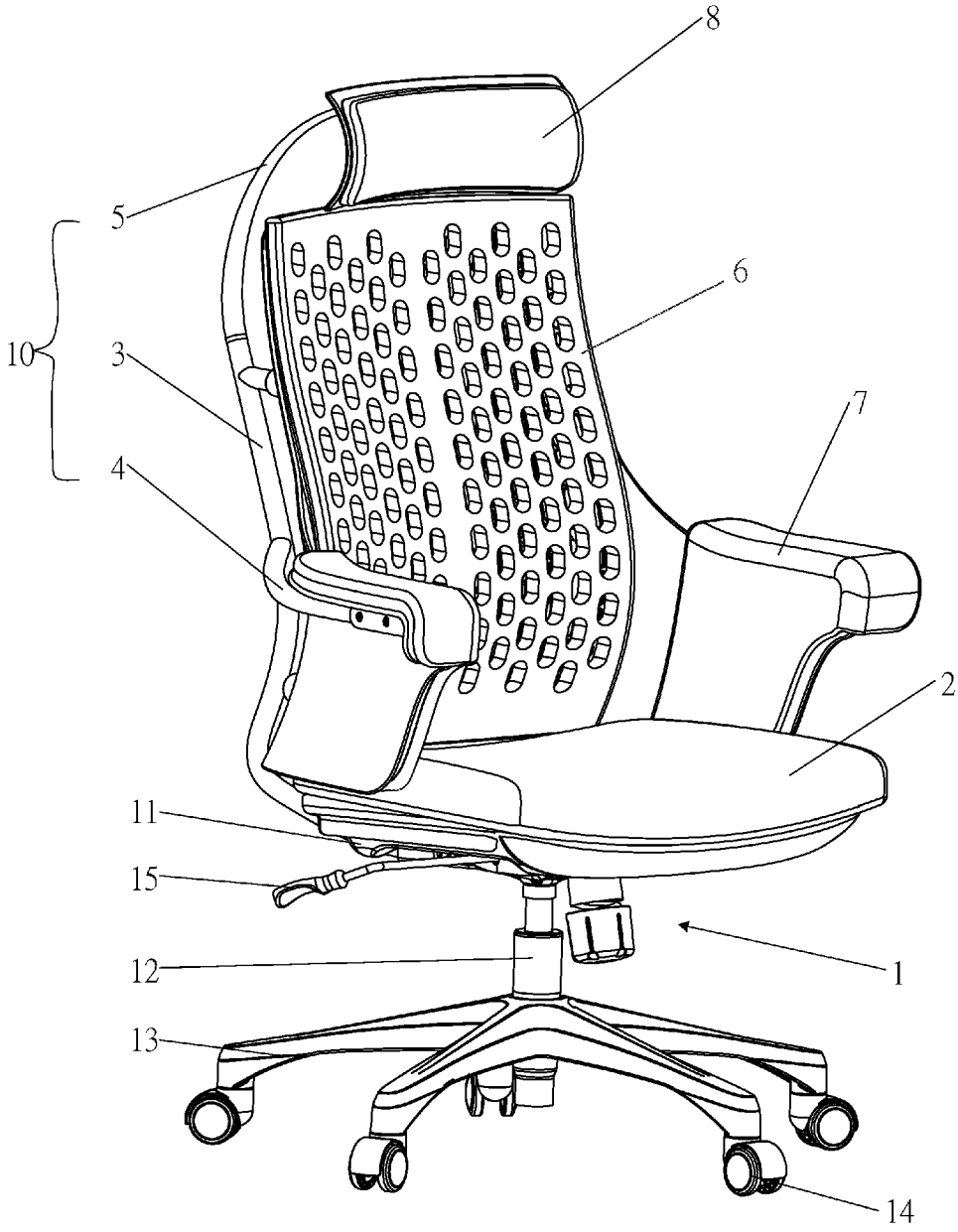
FIG. 1 is a perspective view to show the chair of the present invention.
Figure 2:
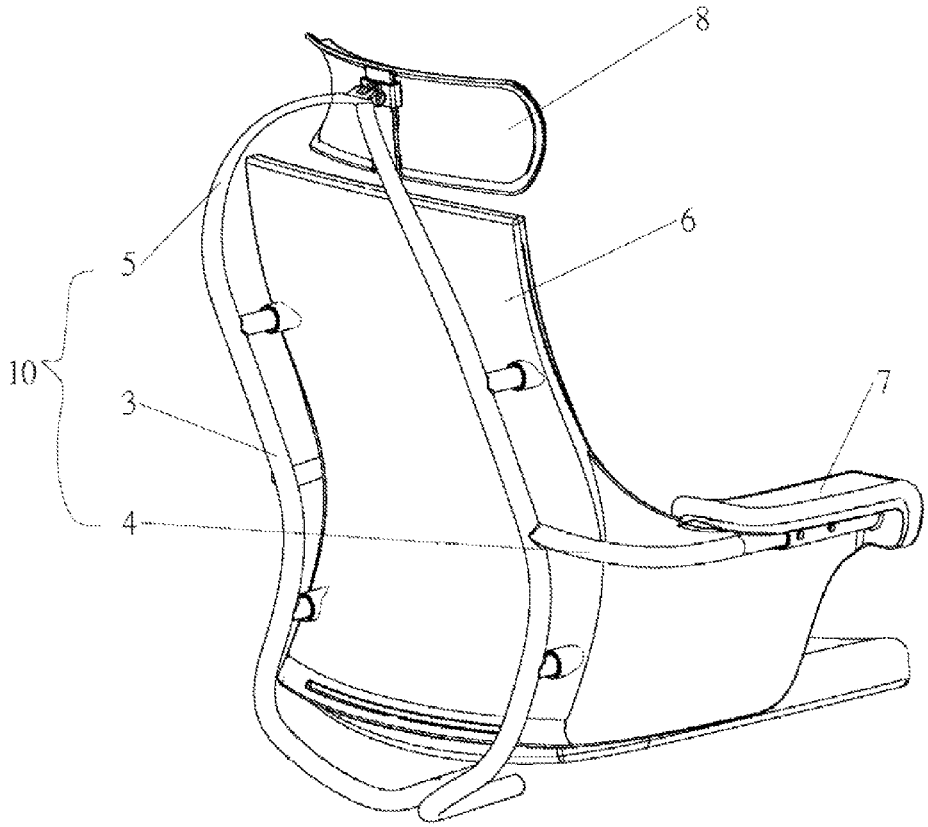
FIG. 2 shows the backrest, the armrest and the headrest connected to the frame unit the chair of the present invention.
Figure 3:
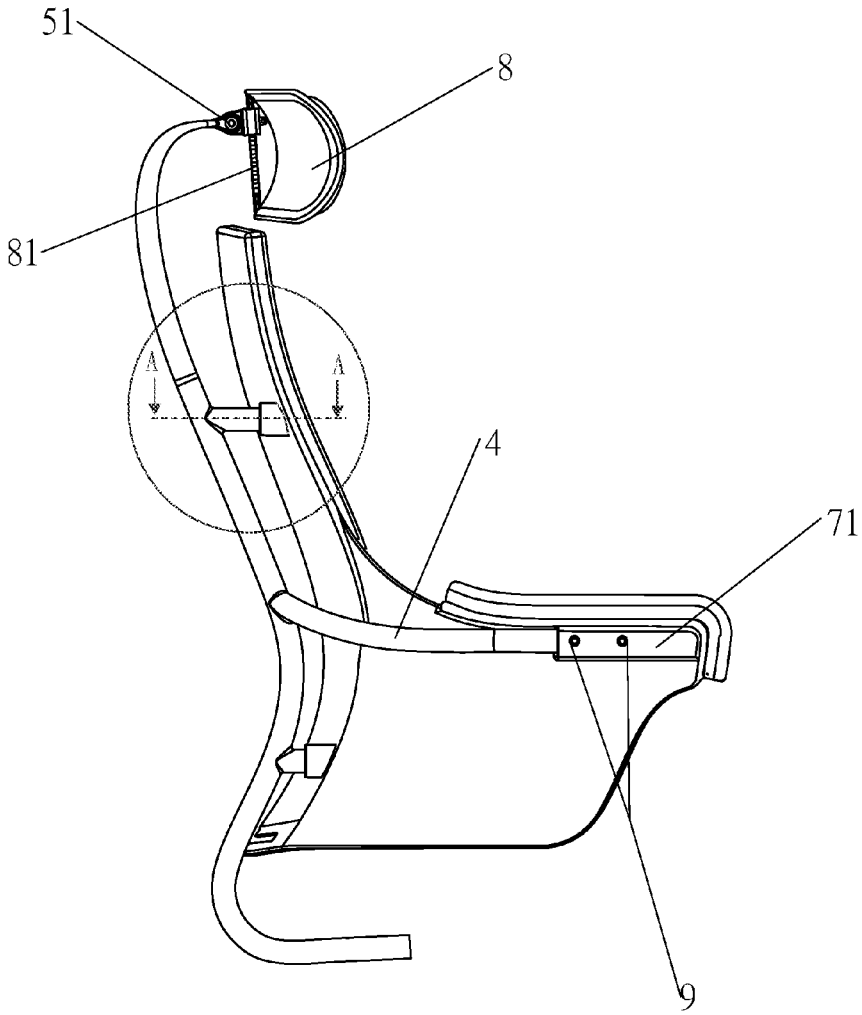
FIG. 3 is a side view of the chair disclosed in FIG. 2.
Figure 4:
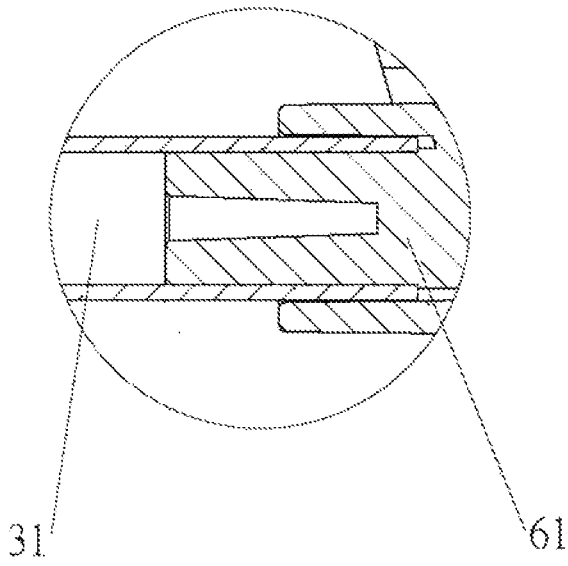
FIG. 4 is an enlarged cross sectional view to show the connection between the backrest and the backrest frame.

Referring to FIGS. 1 to 4, the chair of the present invention comprises a base 1, a seat board 2, a frame unit 10, a backrest 6 and two armrests 7.

The base 1 has a cylinder 12 connected thereto which is connected with multiple legs 13, and each leg 13 has a caster 14 connected thereto. A support frame 11 is connected to the base 1 so as to be connected with the frame unit 10. The base 1 further has a control lever 15 which is used to control the cylinder 12 to control the height of the base 1.

The seat board 2 is connected to the base 1, specifically, to the top of the base 1.

The frame unit 10 has two backrest frames 3 and two armrest frames 4, each of the armrest frames 4 has its lower end connected to the support frame 11 on the base 1. The backrest frame 3 has connection tubes 31 respectively connected to its top and bottom, the connection tubes 31 are circular tubes.

The backrest 6 has connectors 61 on the rear side thereof, and the connection tubes 31 are detachably connected to the connectors 61. By pulling the connection tube 31 and the connector 61 in opposite directions, they can be separated from each other to detach the backrest 6 from the backrest frame 3.

Each of the armrest frames 4 has a first end fixed to the mediate portion of the backrest frame 3 and a second end of each of the armrest frames 4 has a threaded hole. Each of the armrests 7 has a circular tube 71 at the lower end thereof and the circular tube 71 is connected to the armrest frame 4. Each of the circular tubes 71 has holes and bolts 9 extend through the holes and are connected to the threaded holes in the armrest frame 4 to detachably connect the armrests 7 to the armrest frames 4 respectively.

The backrest 6 and the armrests 7 can be made integrally by way of injection molding and by using durable Nylon which is durable and can provide proper curvatures that meet ergonomic requirements. By the specific arrangement, the material of the backrest 6 and the armrests 7 can be detached and/or replaced for the purposes of cleaning and comfortable use.

The chair further has a headrest 8 connected to the headrest frame 5 which is a curved frame and the two ends of the headrest frame 5 are connected to the top of the backrest frame 3. The headrest frame 5 has a securing device 51 at the mediate portion thereof and the headrest 8 has a positioning member 81 on the rear end thereof. The positioning member 81 has multiple recesses and the securing device 51 is securely engaged with the recesses. By adjusting the securing device 51 relative to the recesses, the position of the headrest 8 can be adjusted.

Figure 5:
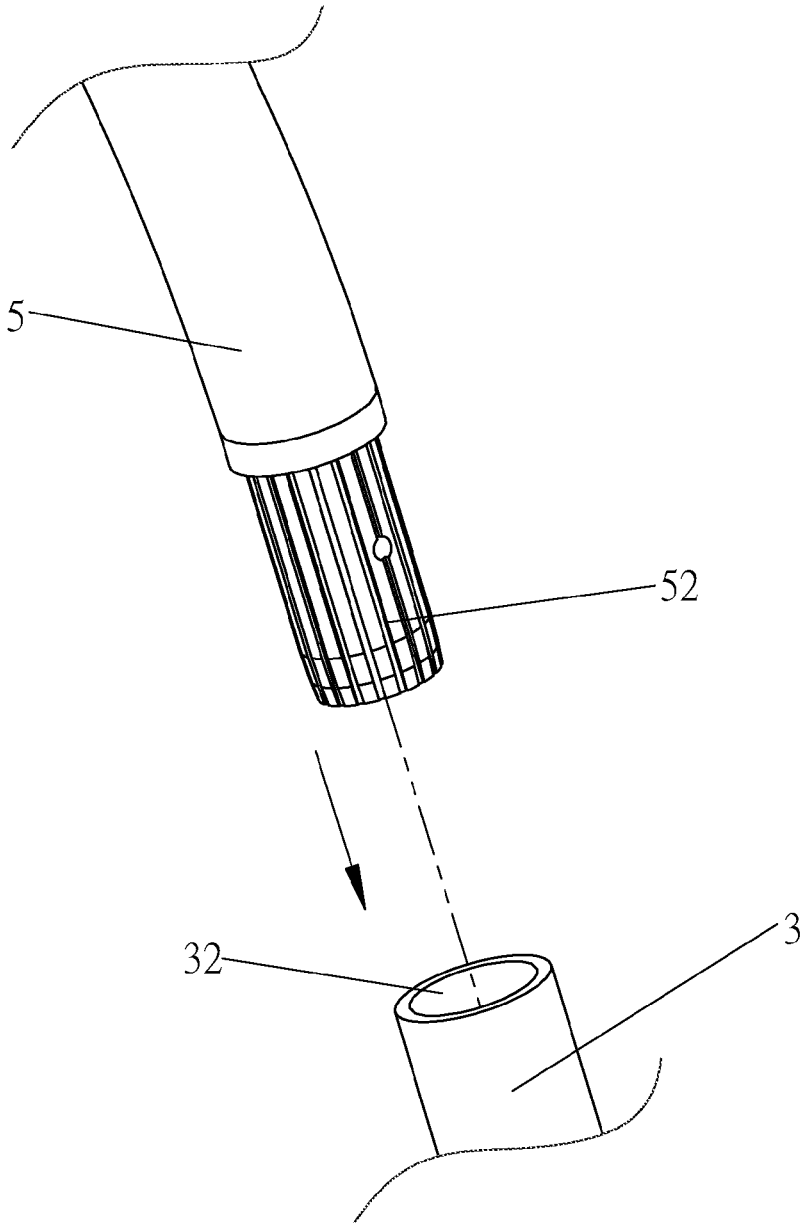
FIG. 5 is an exploded view to show the headrest frame and the backrest frame of the chair of the present invention.

As shown In FIG. 5, the headrest frame 5 has two connection sections 52 extending from two ends thereof. Each of the connection sections 52 has ridges for increasing the friction. The two backrest frames 3 each are hollow tubes and have connection holes 32 in which the connection sections 52 of the headrest frame 5 are connected so that the headrest frame 5 is connected to the backrest frame 3. The headrest frame 5 and the headrest 8 can be optionally detached.

While we have shown and described the embodiment in accordance with the present invention, it should be clear to those skilled in the art that further embodiments may be made without departing from the scope of the present invention.

What is claimed is:

1. A chair comprising:

a base having a cylinder connected thereto which is connected with multiple legs, each leg having a caster connected thereto, a support frame connected to the base and connected with a frame unit which has two backrest frames and two armrest frames, each of the armrest frames having a first end fixed to a mediate portion of the backrest frame, and a second end of each of the armrest frames having a threaded hole;

a seat board connected to a top of the base, and a backrest and two armrests detachably connected to the frame unit, each of the armrests having a circular tube at a lower end thereof and the circular tube being connected to the armrest frame, each of the circular tubes having holes, bolts extending through the holes and being connected to the threaded holes in the armrest frame to detachably connect the armrests to the armrest frames respectively, the backrest frame having connection tubes and the backrest having connectors on a rear side thereof, the connection tubes being detachably connected to the connectors, the backrest and the two armrests being made of Nylon.

2. The seat as claimed in claim 1, wherein the frame unit has a headrest frame which is a curved frame and two connection sections extending from two ends thereof, the two backrest frames each have connection holes in which the connection sections of the headrest frame are connected, a headrest is connected to a mediate portion of the headrest frame.

3. The chair as claimed in claim 2, wherein the headrest frame has a securing device at the mediate portion thereof and the headrest has a positioning member on a rear end thereof, the positioning member has multiple recesses and the securing device is securely engaged with the recesses.

* * * * *